US005423156A

United States Patent [19]

Nellessen, Jr.

[11] Patent Number: 5,423,156

[45] Date of Patent: Jun. 13, 1995

[54] SHEATHING STRAP AND ALIGNMENT GUIDE

[76] Inventor: Peter Nellessen, Jr., 15945 83rd Way North, Palm Beach Gardens, Fla. 33418

[21] Appl. No.: 109,952

[22] Filed: Aug. 23, 1993

[51] Int. Cl.[6] ..... F04B 1/38

[52] U.S. Cl. ..... 52/715; 52/702; 52/696; 403/400; 403/232.1; 403/396

[58] Field of Search ..... 52/712, 173, 715, 489.1, 52/665, 664, 696, 297, 818, 702; 403/400, 403, 396, 395, 232.1

[56] References Cited

U.S. PATENT DOCUMENTS

| | | | |
|---|---|---|---|
| 591,405 | 10/1897 | Jenkins | 52/702 |
| 3,623,755 | 11/1971 | Ratliff, Jr. | 52/702 |
| 3,696,571 | 10/1972 | Schluter | 52/664 |
| 4,246,736 | 1/1981 | Kovar et al. | 52/712 |
| 4,498,801 | 2/1985 | Gilb | 403/232.1 |
| 4,527,375 | 7/1985 | Braginetz | 52/712 |
| 4,592,186 | 6/1986 | Braginetz | 403/400 |

*Primary Examiner*—Carl D. Friedman
*Assistant Examiner*—Winnie S. Yip

[57] ABSTRACT

The instant invention is a strap for installation over sheathing to hold the sheathing to an underlying structural frame member through the use of interconnecting bands and saddle. The saddle is positioned on the underside of a structural member and receives the bands. Tabs are provided at both ends of the sheathing strap to receive the connecting bands and are also used to align the strap with an underlying structural member. Patterns of through holes are provided in the strap as a fastener alignment guide and are to be used for installation of fasteners after the strap is aligned with the underlying structural member.

9 Claims, 3 Drawing Sheets

SHEATHING STRAP AND ALIGNMENT GUIDE

FIELD OF THE INVENTION

This invention relates to the construction of buildings and more particularly to the securing of sheathing material used in the construction of roof sections, wall sections and the like structural sections to provide resistance to structural failure caused by external influences such as wind generated loading.

DESCRIPTION OF RELATED ART

Current methods employed in building construction to fasten sheathing material to an underlying truss or to other frame members utilize nails or fasteners to attach the sheathing to the frame member. The type and quantity of fasteners required for resistance to wind loading, for example, is defined in the various building codes. The "Standard Building Code" copyrighted by the Southern Building Code Congress International, Inc, is one such building code that many building authorities use as a guide in preparing their own particular local building codes.

When nails or other fasteners are used to attach sheathing to frame members, the fasteners, many times, do not get properly installed in the truss, rafter or other frame member to take full advantage of the structural support offered by the member. Improper installation of fasteners on assemblies requiring sheathing is due to the incorrect location used at the time of the fastener installation. One reason for improper installation is that the location of the underlying frame member is hidden from view when the sheathing is placed over the frame member.

Correct fastener installation dictates that a chalk line be located on the sheathing to indicate the centerline of the underlying frame member. Fasteners are then installed using the reference line as a guide. However, common building construction practice is to visually estimate the centerline of the structural member and to install the fastener in the sheathing without an actual reference location. As a result of this practice, some fasteners do not enter the frame member at all or enter the frame member at an incorrect location so that they break out to the side of or break out a section of the frame member.

Improperly installed fasteners reduce the structural loading capability of the sheathing and of the assembly. For example, when using nails as the fastening method, the holding force of each nail in the assembly depends upon the frictional forces generated between the shaft of the nail and the member that it is installed in. To take full advantage of the potential for holding capability, fasteners must be installed completely into the middle of the frame member.

Improper fastener installations weaken the assembly and reduce the resistance of the assembly to structural loading. When movement caused by expansion and contraction occurs in a roof assembly, improperly installed fasteners tend to "walk out" or to be pushed out of the assembly and then puncture the overlying waterproof paper or membrane allowing water to seep into the roof assembly.

Additionally, even when fasteners of the prior art are installed properly, the fasteners offer relatively small areas of contact with the sheathing material. Environmental forces, such as wind loads that are commonly generated by severe storms, most notably hurricanes, may provide forces sufficient to pull through the sheathing free from the fastener, potentially causing structural failure of the assembly.

Prior art does not disclose an apparatus used to hold sheathing to a truss or other structural frame member in the manner of this instant invention. While various configurations of straps and tie downs exist, these do not apply directly to sheathing installations. Therefore what is lacking in the art is a sheathing strap that is anchored to the underlying frame member, said strap including a means for aligning conventional fasteners directly to the strongest portion of said frame member.

SUMMARY OF THE INVENTION

This invention provides an apparatus which acts to mechanically hold the sheathing to a structural member and as a fastener alignment guide to assure that fasteners are properly aligned and installed into the structural member.

The invention consists of a strap with tabs at each end of the strap installed over the sheathing material. The tabs overlap at opposite ends of the sheathing material and position on each side of the frame member. The tabs are used in conjunction with connecting bands and a saddle arrangement that is positioned adjacent to the tab location on the backside of the structural frame member. The saddle couples to the strap, via the connecting bands, securing the sheathing to the frame member.

Through holes are located at specific points along the length of the strap providing a means to assure correct fastener installation through the underlying sheathing and into the frame member. When both sets of tabs are placed over the sheathing and juxtaposition to the underlying frame member, the strap is aligned parallel to the axis of the underlying frame member. The hole patterns lie on or near the centerline of the frame member. Another set of hole patterns are provided in the strap for attaching two abutting sheets of sheathing material to one structural member. Nails or other fasteners can then be inserted into the proper hole pattern in the strap and then installed through the sheathing and into the structural member, in the correct location, so that the fasteners enter the frame member at the proper points and do not miss or break through the side of the member.

Once the strap has been positioned on the sheathing and fastened down, the tabs on the strap are then mechanically secured to a saddle type arrangement utilizing connecting bands that can be tightened and locked either by hand or by the use of a tool. The saddle arrangement is utilized so that the loads transmitted through the strap can be spread out, or distributed, more uniformly to the structural member without damaging it.

After the installation of the strap is completed, a protective barrier material may be installed over the exposed strap or the strap may be coated, if needed, depending on the strap construction material and type of roof barrier or underlayment employed in the construction of the roof.

The apparatus can be used in constructing various building section installations such as walls, roofs, decking or others as described further in this application.

Other advantages and features will become apparent from the following description and from the claims.

BRIEF DESCRIPTION OF THE DRAWINGS

FIG. 3 is a top view of a roof assembly with the frame member and sheathing in place prior to installing the strap showing two common types of assembly joints, FIG. 4 is a top view of the roof assembly with the strap in place, prior to fastening, with one set of tabs bent and the other set of tabs prior to bending.

FIG. 5 is a top view of the roof assembly with the strap fastened in, place and with both sets of tabs bent.

FIG. 6 is a side view of the roof assembly showing the connection of the saddle to the strap, FIG. 7 is an end view of the strap assembly showing the connection of the saddle to the strap, FIG. 8 is a top view showing the gap between sheathing generated by the strap tabs and installation of the chaffing barrier material over the installed strap prior to installation of the roof covering.

DESCRIPTION OF THE PREFERRED EMBODIMENT

The drawings represent a typical installation of the instant invention in a building roof assembly. The installation discussed is representative of various building constructions which include, but not limited to, roof, decking, wall sections and the like.

Figure 11:
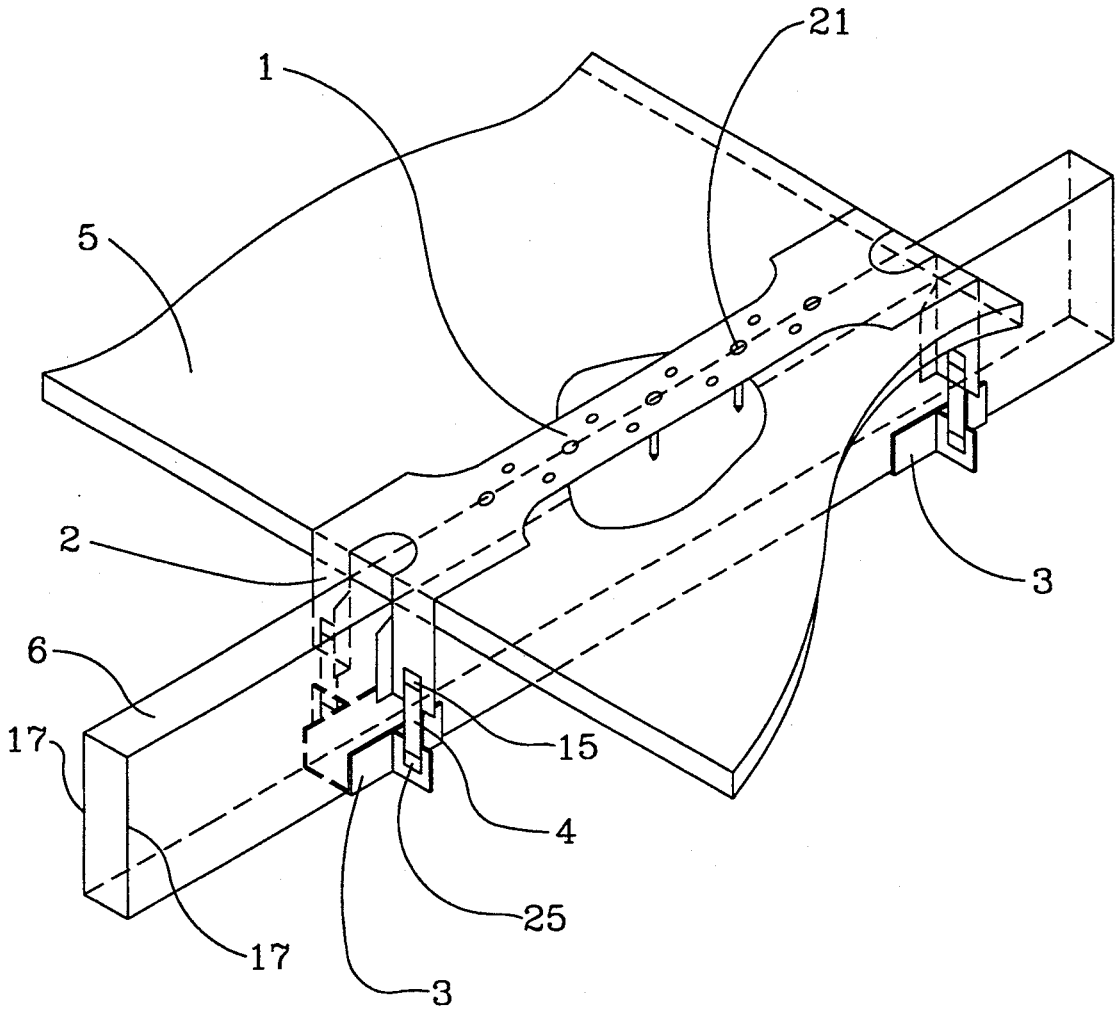
FIG. 11 is a perspective view of the strap assembly installed on a typical building roof assembly prior to installation of the waterproof covering.

Referring to FIG. 11 a pictorial view illustrates the sheathing strap 1 installed on a building assembly fastened to sheathing 5 and frame members 6 prior to installing an overlying barrier or the like waterproof covering material. Tabs 2 are bent down and toward the frame member 6 approximately 90 degrees from the surface of the strap 1 on each side 17 of the frame member 6 and are attached to saddle 3 by connecting bands 4. After bending tabs 2 on each strap 1 end, fasteners 21 are installed into specific hole patterns 8 & 11 in strap 1. These hole patterns act as alignment guides, depending upon the type of sheathing joint used, so that the fasteners 21 can be installed completely into the frame member 6 without missing it or breaking through the sides 17 of the frame member 6. Connecting bands 4 are installed on strap 1 through openings 15 in tabs 2 and in saddle 3 through receptacles 25 during the sheathing installation process or may be installed from the backside of the section after the assembly is completed. Connecting bands 4 are also used to accommodate for heights of commonly used frame members.

Figure 1:
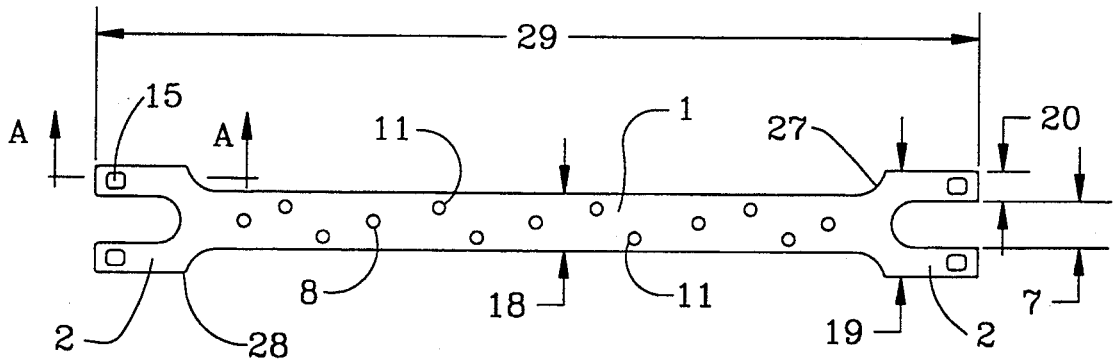
FIG. 1 is a top view of the strap prior to installation on the building assembly.
Figure 2:
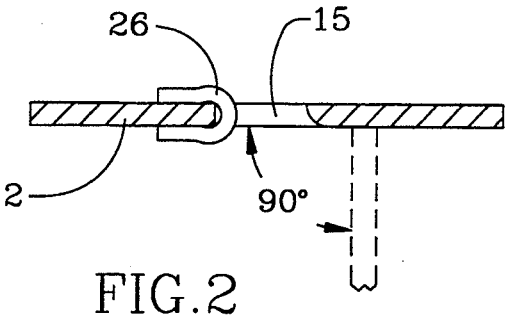
FIG. 2 is a sectional view A—A through a strap tab showing the detail of the tab opening area for a metal strap.
Figure 6:
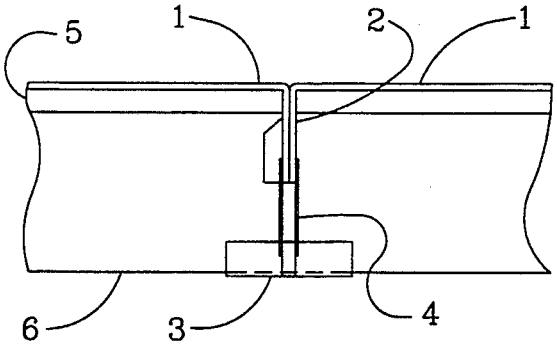
Figure 7:
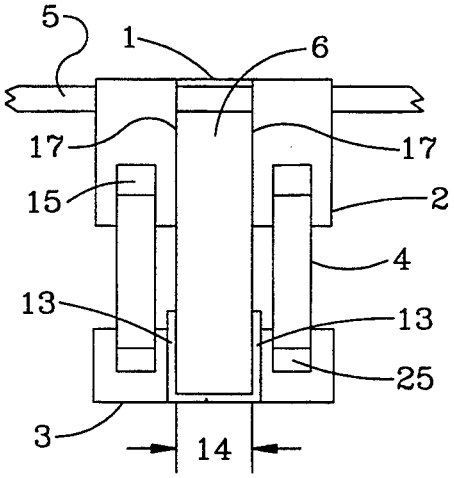

Referring to FIG. 1 strap 1 is shown prior to installation on the sheathing 5. Strap 1 contains two sets of tabs 2 at each end. Referring to FIGS. 6, 7 and 11 openings 15 in tabs 2 are used for connection of the strap to a saddle 3 by connecting bands 4. These openings 15 may be produced by various methods depending on the material of the strap 1. Referring to FIG. 2 when metal is used as the strap 1 construction material, the openings 15 may be punched into the strap 1 so that there are no sharp edges that contact the connecting bands 4. The material punched out or removed out of the opening 15 is bent over to form a smooth radius for the connecting bands 4 without causing stress concentrations, or inserts 26 may be installed to provide the smooth radius for the connecting bands 4. When strap 1 is fabricated from nonmetallic material, openings 15 may be molded into the strap 1 tabs 2. Other construction methods for installing the openings 15 into the tabs 2 may also be employed during the manufacture of the strap 1 as desired.

Referring again to FIG. 1 the shape and configuration of the strap is shown. The width 18 at the center portion of strap 1 is determined by the nailing patterns 11 for abutting joints and the width of the frame member 6. Width 19 at the tab 2 area of strap 1 is greater than width 18 and is determined by the width 20 of each of the two tabs 2 and by the gap 7 between tabs 2. Gap 7 is determined by the width of frame member 6. Commonly used frame member sizes are referred as "two bys" which are one and one half inches wide by various heights. Therefore, gap 7 commonly will be slightly larger than the one and one half inch width of a common frame member.

Frusto conical radii 27 and 28 are installed on strap 1 during manufacture in all areas where cross sectional dimensions change in width. Radii 27 are concave and their function is to reduce stress concentrations at sharp corners that could cause tearing of the strap 1 material and failure of strap 1 when forces are applied to strap 1. Radii 28 are convex and their function is to eliminate sharp corners to reduce the potential for damage to the protective membrane and to also reduce the potential for injuries to installers due to sharp corner edges.

Patterns of holes 8 & 11 will be installed in the strap 1 during the time of manufacture. After strap 1 is aligned with the frame member 6 these patterns act as an alignment guide to correctly position fasteners, depending on the type of sheathing joint used, so that they are properly installed through the sheathing 5 and into the underlying frame member 6.

The length 29 of strap 1 is determined by the size of sheathing used. Sizes of commonly used sheathing is four feet wide by eight feet long in various thicknesses ranging from one quarter to one inch thick or more. Sheathing is normally installed per code with the width or shortest side of the sheathing parallel to the centerline of the frame member 6. Strap 1 would then be installed over the width of the sheathing dictating a strap 1 length 29 of four feet plus several inches to allow for overlap of the tabs 2 at each ends of the strap 1. Strap 1 could also be produced in various lengths depending upon the lengths most commonly used in sheathing construction or it may be produced with an adjustment feature to fit various sizes of sheathing.

Figure 3:
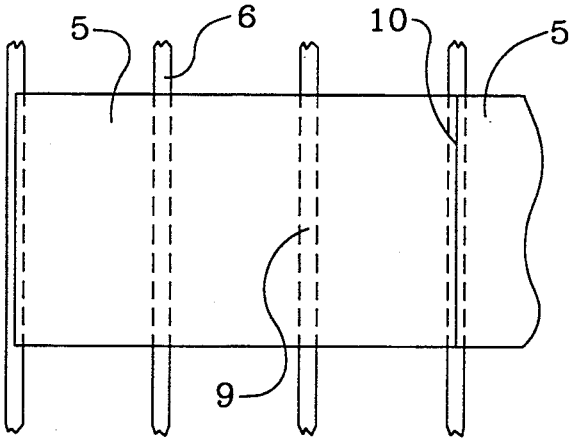
FIGS. 3–8 show the progression of construction of a roof section assembly utilizing the strap described as follows.
Figure 4:
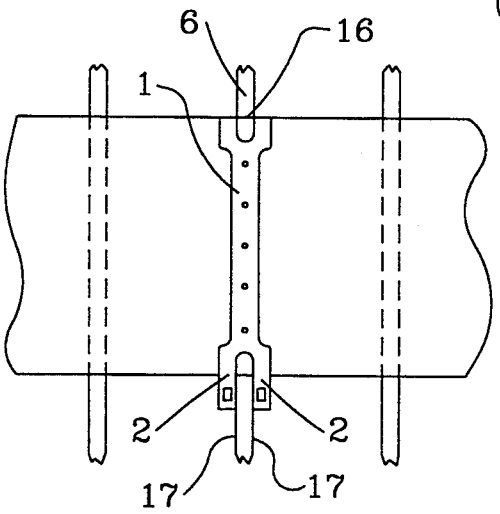
Figure 5:
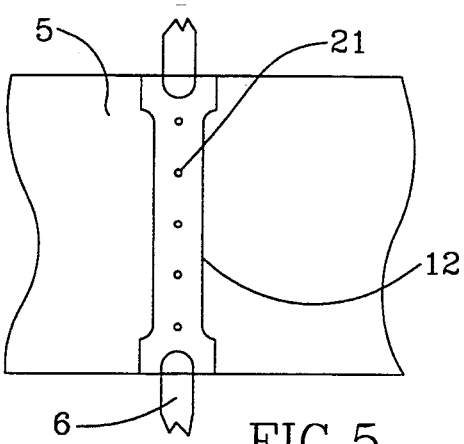

Now relating in general to FIGS. 3 through 8, the following sets forth the sequence of steps that will occur when installing the strap 1 to a building assembly.

a) Referring to FIG. 3 roof sheathing 5 is placed over the structural frame members 6. Frame members 6 can be of various types and design such as a truss, rafter, wall frame or the like normally employed in the construction of a building.

b) Referring to FIG. 4 after installation of the frame member 6 and placement of the sheathing 5, the strap 2 is placed over the sheathing 5 at the juncture 16 of the sheathing and the frame member. First, one set of tabs 2 are bent towards the member 6 and away from sheathing 5 at an approximately 90 degree angle relative to the surface of strap 1. The tabs 2 may be bent at the required angle during manufacture, prior to installation or may be bent into place with the strap positioned over the sheathing 5. The bent tabs 2 are then placed over the sheathing 5 and over the frame member 6 where the two bent tabs 2 contact the two sides 17 of the frame member 6. The strap 1 is then slid along the sheathing 5 until the bent tabs 2 contact the outer edge of the sheathing 5 at juncture 16.

c) Referring to FIGS. 5 and 1 the opposite set of tabs 2 are then bent over the edge of the sheathing 5 and over the frame member 6. At this point, when both sets of tabs 2 contact and are adjacent to the sides 17 of frame member 6, the strap 1 is aligned over the frame member 6 at the correct location. The hole patterns 8 or 11 then act as an alignment guide and present the correct positions for installation of the fasteners 21 through the sheathing 5 and into the frame member 6, even though the frame member 6 cannot be seen. Once in place, fasteners 21 are inserted into their respective holes and installed through the sheathing 5 and into the frame member 6 starting at the center point 12 of strap 1 and progressing outward toward each set of tabs 2 to assure that strap 1 is installed flat on sheathing 5. Refer to FIGS. 3 and 1 the center row of holes 8 is used as a guide when attaching sheathing 5 at a location 9 where there are no abutting sheathing joints. At installation point 10 where two pieces of sheathing abut to form a sheathing joint, the two rows of holes 11 will be used as the guide for fastener installation. The correct row of holes must be used for the type of joint employed for proper installation and insertion of the fastener into the frame member. Refer to FIG. 5 for the installation of a strap 2 using fasteners 21 at a location 9 where there are no abutting sheathing 5 joints.

d) Refer to FIG. 6 and FIG. 7 for installation of the saddle 3 using connecting bands 4 and tabs 2. After all fasteners have been installed, the saddle 3 is placed on the backside of frame member 6 at approximately the location of the tabs and attached to the bent tabs 2 by connecting bands 4. Connecting bands 4 may be any type of bands that tighten and lock by hand or through use of a tool. Connecting bands may be installed to hold adjacent strap 1 tabs 2 to the saddle 3 or may be installed to hold one set of strap 1 tabs to the saddle 3 only, depending upon the installation location. Receptacles 25 are installed in the saddle 3 to receive connecting bands 4. The sides 13 of the saddle 3 will be bent inward slightly and toward each other during manufacture to produce a gap 14 that is slightly smaller than the width of the frame member 6. When installed on the frame member 6, the saddle 3 will then stay in place held by frictional forces produced between the saddle 3 sides 13 and the sides 17 of the frame member 6 without falling off, damaging or breaking into the frame member 6.

Referring to FIGS. 6 and 1 connection bands 4 may be installed through openings 15 in strap 1 and receptacles 25 in saddle 3 before the adjacent sheathing 5 and strap 1 is installed or connection band 4 may be installed from the backside in a like manner after the section is completed.

Figure 8:
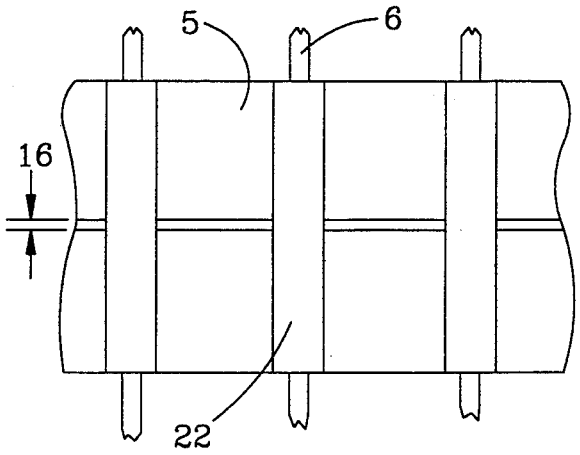

Refer to FIG. 8 gap 16 between two pieces of sheathing 5 is consistently maintained by the installation of two adjacent straps 1 above and to the side of sheathing 5. The width of gap 16 is determined by the thickness of tabs 2. Gap 16 is required to allow for expansion and contraction of the building assembly without damaging the assembly.

Figure 9:
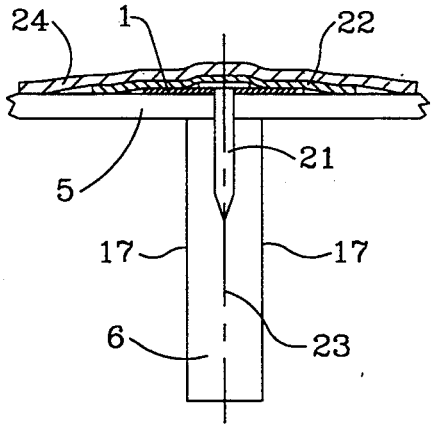
FIG. 9 is a sectional view through a frame member at a typical fastener showing the installation of the fastener at a position on the sheathing where there is no sheathing joint.
Figure 10:
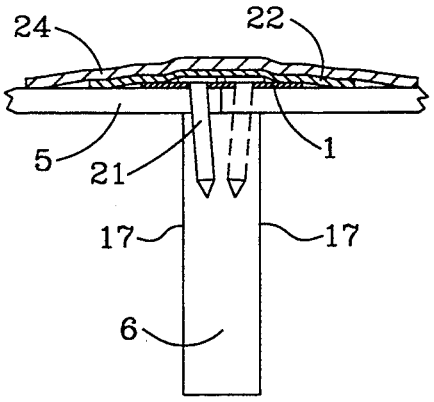
FIG. 10 is a sectional view through a typical fastener showing the installation of the fastener at an abutting sheathing joint.

Refer to FIGS. 9 and 10 showing the benefits of the alignment guide feature of the strap 2 for proper installation of the fastener 21. FIG. 9 shows the fastener 21 at location 9 where there is no sheathing joint using hole pattern 8 in strap 1. The fastener 21 is correctly installed on or near the centerline 23 of the frame member 6 where the fastener can provide its full holding potential in the assembly. FIG. 10 shows the installation of fastener 21 installed at an abutting joint position 10 in the sheathing using hole pattern 11. The fastener 21 is correctly installed in the frame member 6 so that it can provide full holding potential in the assembly while also adequately supporting and preventing fastener 21 head pull through of the abutting edges of the sheathing.

e) Referring again to FIGS. 8, 9 and 10 after installation of the strap 1 is completed, a strip 22 of building paper, mastic or other type of protective covering may be applied to the outer surface of the strap 1 to act as a chaffing barrier between the strap 1 and the underlayment 24 employed in the assembly. This strip 22 is required only when there is a potential for the strap to puncture the water proof underlayment or membrane that makes up the building section such as when a metallic strap is installed on a roof assembly. The strap 1 may also be coated with a material that provides chaffing protection at the time of manufacture in lieu of installing the strip 22. Most building installations will not require the application of the strip 22 after the strap 1 is installed as there is normally more than one layer of waterproofing material 24 installed. Additionally, if the strap is made from nonmetallic material, a chaffing strip 22 will not normally be required.

Although the invention is described with respect to a preferred embodiment, modifications thereto will be apparent to those skilled in the art. Therefore, the scope of the invention is to be determined by reference to the claims which follow.

What is claimed is:

1. An apparatus for securing roof sheathing to an underlying support structure to maintain the sheathing in a fixed position to resist hurricane force winds, said apparatus comprising: a strap formed from a single piece of rigid material having a first end and a second end defining a length of at least four feet therebetween, said first end having a first width wider than an underlying support structure with a center opening dividing said first end into two spaced apart bendable tabs for perpendicular disposition in a parallel relation to each side surface of an underlying support structure, said second end forming a mirror image of said first end having a width wider than the underlying support structure with a center opening dividing said second end into two spaced apart bendable tabs for perpendicular disposition in a parallel relation to each side surface of an underlying support structure, said length having a central potion having a second width equal to a width of said center opening of said first end and said second end; template means for aligning said length of said strap to said underlying support structure hidden beneath said sheathing; and means for coupling said tabs to said underlying support structure; said coupling means including adjustable flexible bands; whereby placement of said strap over sheathing allows juxtapositioning of said tabs to said underlying support structure wherein said strap is secured to said sheathing and said underlying support structure.

2. The apparatus for securing sheathing according to claim 1 wherein said means for coupling is further defined as a U-shaped saddle bracket adaptable disposed beneath said underlying structure secured to said tabs by adjustable bands.

3. The apparatus for securing sheathing according to claim 1 wherein said template means for aligning is defined as a plurality of through holes positioned along the length of said strap directly above at least a portion of a longitudinal length of an underlying support.

4. The apparatus according to claim 3 wherein said through holes are disposed in a predetermined pattern for providing correct positioning of fastening nails or screws into said underlying structure hidden beneath the sheathing.

5. The apparatus for securing sheathing according to claim 1 wherein said first end and said second said first width of said first end said second end having a frusto conical radii leading to said second width.

6. An apparatus for securing roof sheathing adapted to be associated with underlying support structure of a building and be disposed intermediate of finish material, said apparatus comprising: a strap having a first end and a second end defining a length of at least four feet therebetween, said first end defined by two spaced apart formable tabs disposed in parallel relation, said first end and said second end are of a first width and said length therebetween of a second width, said first width having a frusto conical radii leading to said second width and a plurality of through holes positioned along the length of said strap; said second end forming a mirror image of said first end; a substantially U-shaped saddle clamping element for use in combination with said underlying support structure and operatively associated with said tabs of said strap; a plurality of adjustable bands for coupling said tabs of said strap to said saddle; whereby placement of said strap over sheathing allows juxtaposition of said tabs to a top portion of an underlying support structure wherein securement of said saddle to a bottom of said underlying support structure allows coupling of said tabs by adjustable bands.

7. The apparatus for securing sheathing according to claim 6 wherein said strap includes a means for aligning said strap to the underlying support structure.

8. The apparatus for securing sheathing according to claim 5 wherein said strap includes a plurality of through holes disposed in a predetermined pattern for providing a template for attaching said sheathing to said underlying support structure by placement of fasteners through said holes.

9. A process for securing sheathing to roof of a building comprising the steps of:

(a) placing a roof sheathing over a structural frame member during the construction of a building;

(b) setting a strap having a plurality of through holes disposed along a longitudinal length thereof over said sheathing, each end of said strap having two spaced apart bendable tabs disposed in a parallel relation for disposition on each side of said structural frame member aligning said through holes over said structural frame member;

(c) inserting fasteners through said through holes, said through holes aligned to said structural member for directing insertion thereto;

(d) positioning a substantially U-shaped saddle clamping element for use in combination with said structural frame member beneath each said end;

(e) securing said saddle underlying said structural frame member;

(f) coupling a plurality of adjustable bands between said saddle and said strap; and (g) adjusting said band to secure said strap to said saddle.

* * * * *